United States Patent [19]

Wallace et al.

[11] Patent Number: 4,463,946

[45] Date of Patent: Aug. 7, 1984

[54] FITNESS EVALUATION APPARATUS

[76] Inventors: Lynn A. Wallace, P.O. Box 255, Shaker Heights; Max E. Sallach, P.O. Box 313, Chesterland, both of Ohio 44026

[21] Appl. No.: 334,971

[22] Filed: Dec. 28, 1981

[51] Int. Cl.[3] ..... A63B 71/06

[52] U.S. Cl. ..... 272/111; 272/DIG. 5; 434/258; 273/1 GC; 273/1 GF; 73/379

[58] Field of Search ..... 73/432 R, 379; 128/774; 272/93, 129, 144–146, DIG. 5, DIG. 6, 69; 273/1 GC, 1 GF, 1 G, 1 E, DIG. 28; 434/247, 258, 185, 350–352

[56] References Cited

U.S. PATENT DOCUMENTS

| | | | |
|---|---|---|---|
| 2,764,411 | 9/1956 | Washburn, Jr. | 272/1 |
| 3,389,910 | 6/1968 | Kanzler, Jr. | 273/1 |
| 3,848,467 | 11/1974 | Flavell | 272/129 |
| 3,869,812 | 3/1975 | Arakelian et al. | 434/258 |
| 3,960,376 | 6/1976 | Berlin | 434/258 |
| 3,995,852 | 12/1976 | Mendelson | 272/111 |
| 4,012,852 | 3/1977 | Journot et al. | 434/185 |
| 4,099,713 | 7/1978 | Spector | 272/93 |
| 4,278,095 | 7/1981 | Lapeyre | 272/69 |

FOREIGN PATENT DOCUMENTS

| | | | |
|---|---|---|---|
| 2038597 | 7/1980 | United Kingdom | 272/146 |

OTHER PUBLICATIONS

Diefenbach, B.; DT3001768; Jul. 1981.

*Primary Examiner*—Richard C. Pinkham
*Assistant Examiner*—Leo P. Picard
*Attorney, Agent, or Firm*—Squire, Sanders & Dempsey

[57] ABSTRACT

An apparatus for quantitatively measuring a person's physical fitness, agility and reaction time by measurement of the ability to maintain and regain balance including a balance beam on which the test subject stands, a counter for counting the number of times balance is lost during a test cycle and a timer for timing the duration of imbalances during the test cycle.

15 Claims, 4 Drawing Figures

FITNESS EVALUATION APPARATUS

The present invention relates to apparatus for measuring the physical fitness, agility and reaction time of a person.

The physical condition of a person is conventionally quantitatively measured by complex tests which generally involve strenuous exertion on the part of the test subject. The apparatus involved in those tests is generally expensive, relatively large and not portable. The present invention provides an inexpensive, portable apparatus through which the balance and general physical fitness, agility and reaction time of an individual can be quantitatively measured. The tests employing the apparatus of the invention are simple, quick, nonstrenuous and do not fatigue the person tested.

SUMMARY OF THE INVENTION

The advantages of the present invention are achieved through a balance beam on which the person to be tested stands. The beam may rock in the manner of a weighing balance or seesaw as a person stands on it. As the person stands on the beam, he attempts to remain balanced, that is, to maintain the beam in a generally horizontal alignment, but generally seesaws in and out of balance. The apparatus counts the number of times the beam goes out of balance and measures the time that it remains out of balance. The ability of a person to maintain the beam in balance is an index of the physical fitness of the person. The number of balance losses and the imbalanced portion of a test period is a quantitative measure of the balancing ability, i.e., the agility, of the test subject. The relative proportion of imbalances to each side provides a measure of the relative condition of each longitudinal half of the body. The ratio of the out-of-balance time to the number of losses of balance is a quantitative measure of reaction time. Reaction time may be measured for each side imbalance.

The apparatus includes mechanical or electronic means of counting the number of losses of balance and measuring the duration of imbalance. Both the mechanical and electronic means include a visual display from which the count and duration may be determined. With the electronic means, the reaction time may be calculated automatically and visually displayed.

A measuring cycle may be begun manually with the test subject starting from an imbalance position or automatically when the test subject has achieved a balance position. A test cycle may be ended automatically at the end of a fixed time.

DESCRIPTION OF PREFERRED EMBODIMENTS

Figure 1:
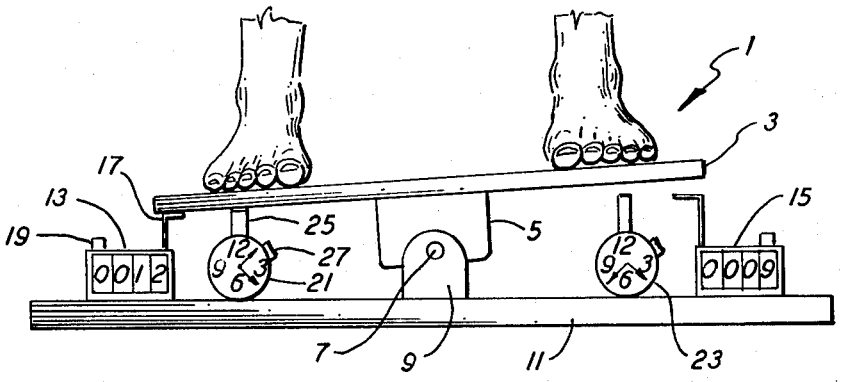
FIG. 1 is a schematic diagram of an embodiment of apparatus according to the invention employing mechanical counting and timing means.

By using the apparatus of the invention, the ability of a person to maintain and regain his balance is determined as a quantitative measure of his physical fitness. A balance beam means for moving between a position of balance, wherein the person being tested maintains his balance, and positions of imbalance, wherein the person loses or has lost his balance, is central to the invention. An embodiment of such a balance beam means 1 is shown in FIG. 1. There, a rocker board 3 is firmly mounted upon a first transverse support 5 which is pivotally connected by a pivot 7 to second transverse support 9. Transverse support 9 is firmly attached to a base 11 suitable for supporting the apparatus on a floor or other generally horizontal surface. The person being tested stands on rocker board 3 with his feet spaced apart approximately equally straddling pivot 7. The person is in a position of balance when the rocker board is generally horizontal. When balance is lost, the rocker board tips to one side or the other, becoming inclined with respect to the horizontal position. That is, the rocker board acts like a seesaw. The object of a test is to remain balanced. No person can do so indefinitely, but eventually shifts to one side or the other. The natural response is to compensate for the shift in order to regain one's balance. Thus, as a person stands on rocker board 3, there are a series of shifts between the balance position and the imbalance positions. We have found that the length of time a person can remain balanced is an index of his physical fitness and agility. The ability to remain balanced can be measured by the number of times balance is lost in a time period and/or the amount of time or portion of a fixed length test cycle that the board is not in the balance position. The speed of recovery from an imbalance to a balance position is another such index, its inverse being the reaction time of the person being tested. The average reaction time can be determined by dividing the time the rocker board is in an imbalance position by the number of imbalance-to-balance transitions.

The embodiment of the invention depicted in FIG. 1 includes mechanical counting means and timing means for counting the number of balance-to-imbalance balance beam means transitions and for measuring the time the balance beam means remains in an imbalance position, respectively. A conventional mechanical digital counter 13 is located below the left end of rocker board 3 as seen in FIG. 1 and a second similar counter 15 is located below the right end of rocker board 3. Since counters 13 and 15 are similar or identical counters, sometimes called the Veeder-Root type in reference to one manufacturer, description of only one is necessary. Counter 13 has a protruding upwardly mechanically biased lever 17 which advances the accumulated count by one each time it is fully depressed. A reset button 19 resets the accumulated count to zero when depressed. As rocker board 3 tips out of the balance position to the left side imbalance position, lever 17 functions as a switching means for actuating the left counting means in response to the movement of the balance beam means from the balance position to the left side imbalance position. The number of such transitions are accumulated on counter 13. Similarly, counter 15 accumulates the number of times the rocker board moves from the balance position to the right side imbalance position. The sum of the accumulated counts is the number of times during a test that the balance beam means has gone from a balance to an imbalance position. The mechanical timing means includes a conventional stopwatch 21 located beneath the left end of rocker board 3 and a similar stopwatch 23 located beneath the right end of rocker board 3. Again, description of one stopwatch suffices. The watches may be either digital or analog; stopwatch 21 has an upwardly mechanically biased plunger 25 which, when depressed, activates the watch and when released causes the watch to be deactivated. A separate reset lever 27 is used to return the accumulated time to zero. Stopwatch 21 is operated when rocker board 3 is inclined to the left and stopwatch 23 operates when board 3 is inclined to the right. That is, plunger 25 acts as a switching means activating the timing means in response to movement of the balance beam means from the balance position to the left imbalance position and deactivating the timing means in response to the movement from the left imbalance position to the balance position.

The apparatus in FIG. 1 permits measurement of the number and duration of the left side and right side imbalances as well as their respective durations. This information permits a comparison of the relative conditions of the two longitudinal halves of the test subject's body. The result is a quantitative measure of "handedness," i.e., the degree to which one side of the body dominates the other. Likewise, separate reaction times for each side of the body can be calculated by dividing each side's imbalance time by that side's count of imbalances. Alternatively, the sum of the elapsed times accumulated by stopwatches 21 and 23 is the total imbalance time and the sum of the counts accumulated by counters 13 and 15 is total count of imbalances. The quotient of the total time and total count is the average reaction time.

Obviously, FIG. 1 is schematic in nature. The angle to the horizontal at which rocker board 3 swings from the balance to the imbalanced position determines the exact positioning of counters 13 and 15 and stopwatches 21 and 23. In general, we have found that about $\pm 2°$ from the horizontal is an appropriate transition point from the balance position to the imbalance position.

Figure 2:
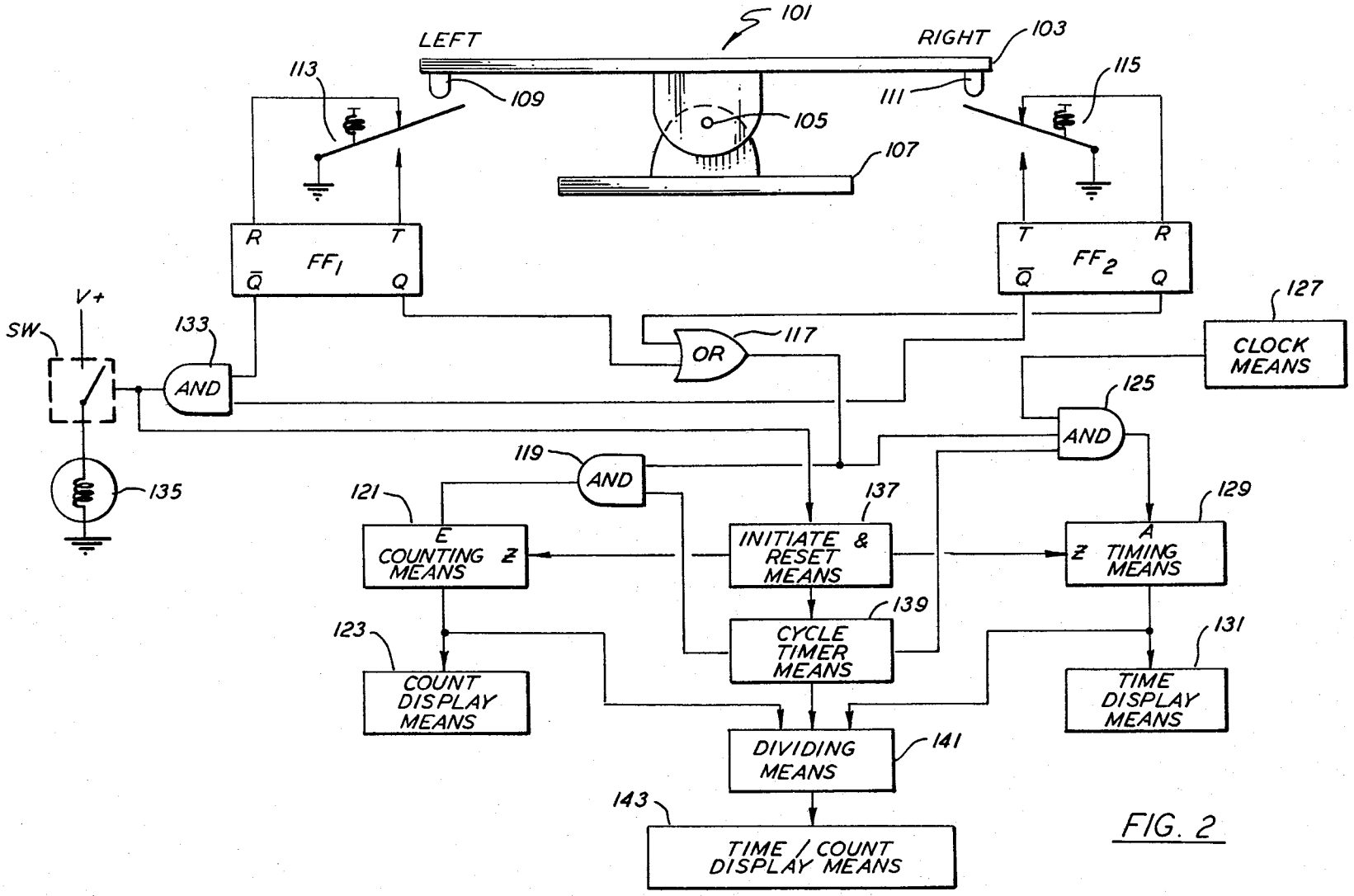
FIG. 2 is a schematic diagram of an embodiment of apparatus according to the invention employing electronic counting and timing means.

By using electronic counting and timing means, the need to sum separate counter and time readings to obtain overall measurements may be eliminated. One embodiment of the apparatus using such electronic means is shown in FIG. 2. There, as before, balance beam means 101 includes a rocker board 103 pivotally connected on pivot 105 to a base 107. The underside of each end of rocker board 103 has a protrusion, protrusion 109 and the left end and protrusion 111 at the right end. A single-pole, double-throw electrical switch 113 is located beneath the left end of board 103 and another similar switch 115 is located beneath the right end of board 103. The movable contacts on each of switches 113 and 115 are grounded and are mechanically biased to contact one pole so that that pole is normally grounded. The other pole of each switch is normally open until switched into contact with the grounded movable contact. Switches 113 and 115 are preferably microswitches capable of detecting small movements. The normally closed poles of switches 113 and 115 are connected to the reset terminals R of RS flip flops $FF_1$ and $FF_2$, respectively. The normally open poles are connected to the setting terminals T of the same flip flops. Each of the output terminals Q of flip flops $FF_1$ and $FF_2$ are connected to one of the two input terminals of an OR gate 117, the output signal of which is supplied to an input terminal of an AND gate 119. The output of AND gate 119 is connected to an enabling terminal E of an electronic counting means 121. The output signal of counting means 121 drives count display means 123 for electrically displaying the output of count means 121. The output signal of OR gate 117 is also supplied to one of the three input terminals of an AND gate 125. A clock means 127 for generating a train of timing pulses is connected to the second input terminal of AND gate 125. The output signal of AND gate 125 is connected to the actuating terminal A of a timing means 129 for counting the timing pulses. Timing means 129 drives time display means 131 for electrically displaying the output of timing means 129. The output terminals $\overline{Q}$ of flip flops $FF_1$ and $FF_2$ are connected to the input terminals of an AND gate 133. The output of AND gate 133 may be connected to actuate a normally open electronic switch SW. One pole of switch SW is connected to a power supply V+ and the other to a balance indicator 135, which in turn is connected to ground. The output of AND gate 133 is connected to the input of an initiate and reset means 135 for initiating a test cycle and resetting the accumulated time and count. The output signal of reset means 139 is connected to reset terminals Z of counting means 121 and timing means 129. The output of initiate means 137 is also connected to the input of a cycle timer means 139 for timing and signaling the end of a fixed length test cycle. The output of cycle timer 139 is connected to the third input terminal of AND gate 125 and to an input terminal of AND gate 119. The output signals of counting means 121, timing means 129 and cycle timer means 139 are connected to a dividing means 141 for producing the quotient of the accumulated time and count at the end of a test cycle. Dividing means 141 drives time/count display means 143 for displaying the quotient produced by dividing means 141.

In operation of the apparatus of FIG. 2, switches 113 and 115 act as a switching means to turn the counting and timing means off and on. The apparatus provides automatic, selectable fixed time cycling beginning when a test subject has first balanced rocker board 103. If the test cycle is not to begin at the balance position and/or is to be manually timed, gates 119 and 133, switch SW, indicator 135 and cycle timer means 139 may be omitted and one input to gate 125 eliminated with appropriate circuit changes which will be apparent to one skilled in the art. Dividing means 141 and display means 143 are optional.

When rocker board 103 is inclined, for example to the left, the lever arm of switch 113 is depressed, opening the normally closed contacts and closing the normally open contacts. When the lever arm of switch 113 is depressed, reset terminal R of flip flop $FF_1$ is disconnected from ground and setting terminal T is connected to ground. As a result, the output signal at the Q terminal of flip flop $FF_1$ switches from low, i.e., a logical zero, to high, i.e. a logical one. The output signal at $\overline{Q}$ is the complement, i.e. in the opposite state, of the signal at the Q terminal. That output signal remains as a one until the reset terminal R is grounded again. The high signal passes through OR gate 117 and is applied to AND gates 119 and 125. If a measuring cycle is underway, the signal at the other input of AND gate 119 is high so that the signal is passed through to counting means 121. The arrival of a high level signal at enabling terminal E of counting means 121, which may be a conventional digital counter, preferably an integrated circuit, causes the accumulated count retained within counting means 121 to be incremented by one. The output signal of counting means 121 drives a count display means 123 which provides an electrical digital display of the count accumulated by counting means 121. When counting means 121 is a conventional counter, it produces a series of high and low signals at a series of output terminals representing in binary format the accumulated count. Count display means 123 then includes conventionally available circuitry for converting the binary coded decimal information into an appropriate format for driving the display means which may be a conventional seven segment display. The display, for example, may use light emitting diodes, luminescent, incandescent or liquid crystal elements to provide digital, visual display of the accumulated count. Thus, each time the switch 113 is depressed during a test cycle, the high level signal from $FF_1$ causes display means 123 to increment the displayed number by one. Generally for test cycles of less than a minute, two digit display means provides adequate capacity. When balance is next achieved, the Q output drops to the low level without effect on the counting or count display means 121 and 123. Similarly, depression of switch 115 during a test cycle causes the number appearing on the display means 123 to be incremented by one.

Clock means 127 includes a timing oscillator producing a regular series of pulses and such dividers as are necessary to produce one hundred, ten or one pulse per second, depending upon the timing accuracy required. Such timing circuitry employing oscillators and multivibrators is conventional. AND gate 125 produces a high level output signal whenever one of switches 113 or 115 is depressed, a clock pulse is present and a test cycle is in progress. Thus, for a pulse repetition rate of 10 pulses per second, 10 pulses will reach the enabling terminal A of timing means 129 for each second switch 113 or 115 is depressed during a test cycle. Timing means 129 is preferably a counter similar to counting means 121 and time display means 131 is similar to count display means 123. That is, timing means 129 counts hundredths, tenths or whole seconds by counting the pulses generated by the clock means while one of the switches is depressed. The accumulated count, in binary coded decimal, is passed to time display means 131 where it is decoded and electrically displayed in visual, digital form. A two digit display in seconds is adequate for test cycles less than one minute in duration, although a third digit giving one tenth second accuracy is desirable, if feasible considering the pulse repetition rate.

At the beginning of a test cycle, display means 123 and 131 are reset to zero by a signal generated in initiate and reset means 137. The reset pulse furnished to the reset terminals Z of counting means 121 and timing means 129 through which the respective displays are cleared is preferably actuated manually, as by the throwing of a switch by the operator of the apparatus, although resetting could be accomplished simultaneously with the initiation of a new test cycle. Generation of the resetting pulse is conventional, as for example, by the differentiation of a pulse generated by a momentary connection to a power supply of the appropriate polarity.

With the circuitry of FIG. 2, a measuring cycle of a fixed, preselected length is commenced by arming initiate and reset means 137. Initiate and reset means 137 may include a flip flop which is armed, for example, by insuring its output signal supplied to cycle timer means 139 is in the low state. Preferably, reset and arming are accomplished simultaneously and manually by the operator of the apparatus. The test subject then stands on rocker board 103 and attempts to balance it. When balance is first achieved, the $\overline{Q}$ output signals of flip flops $FF_1$ and $FF_2$ both take on the high level state so that the output signal of AND gate 133 goes high. The high level AND gate signal then closes switch SW, actuating indicator 135. Indicator 135 may be a light source such as a light emitting diode or incandescent bulb which can signal the operator that a measuring cycle has begun. Indicator 135 may also be electro-optically coupled to initiate means 137 to trigger output signal triggering cycle timer means 129. Alternatively, the output signal of AND gate 133 may be connected directly to initiate means 137 to trigger cycle timer 139. If the displays are reset simultaneously with the initiation of a test cycle, then all output signals of initiate and reset means 137 change state when the output signal of AND gate 133 goes high, otherwise the operation of the rest and time pulses are independent. The triggering of cycle timer means 139, which may include a conventional integrated circuit, for example a 555 timer, causes its output signal at AND gates 119 and 125, to go high for a preselected time interval, for example, 30 seconds. The length of the time interval can be manually adjusted. Thus, for those 30 seconds, counting means 121 and timing means 129 may operate. At the end of the time interval, the states of the output signals of cycle timer means 139 switch, disabling AND gates 119 and 125 from further operation, freezing the displays of counted imbalances and elapsed time of imbalance. Dividing means 141 is then activated by the change in state of the output signal of cycle timer 139, receives the accumulated imbalance time from timing means 129 and accumulated count from counting means 121 and calculates their quotient. Dividing means 141 is preferably a conventional electronic divider such as a conventionally available rate multiplier integrated circuit operating in conjunction with an up counter, a down counter, a zero detector and a clock which may be clock means 127. Alternatively, a more complicated (and expensive) divider means might employ a conventional digital-to-analog converter, logarithmic and difference amplifiers followed by an analog-to-digital converter driving time/count display 143. The output signal of dividing means 141 is converted from binary form and displayed on time/count display means 143 in the same fashion as display means 123 and 131. The circuitry of time/count means 143 is conventional and similar to that of count display means 123 and time display means 131. Likewise, the displays are similar seven segment or other electrical/electronic digital displays. Two digits provide sufficient accuracy for displaying the ratio which is the reaction time of the test subject to the loss of balance.

If elements 119, 133, 135, 137 and 139 are deleted or overridden for manual initiation and termination of a testing cycle, the testing cycle can begin as soon as the apparatus is imbalanced by the test subject. That is, in the subject's mounting of the apparatus, one foot at a time, rocker board 103 will tilt and the test cycle will begin. The operator will then manually open the connections to counting and timing means 131 and 129 to terminate the cycle.

Figure 3:
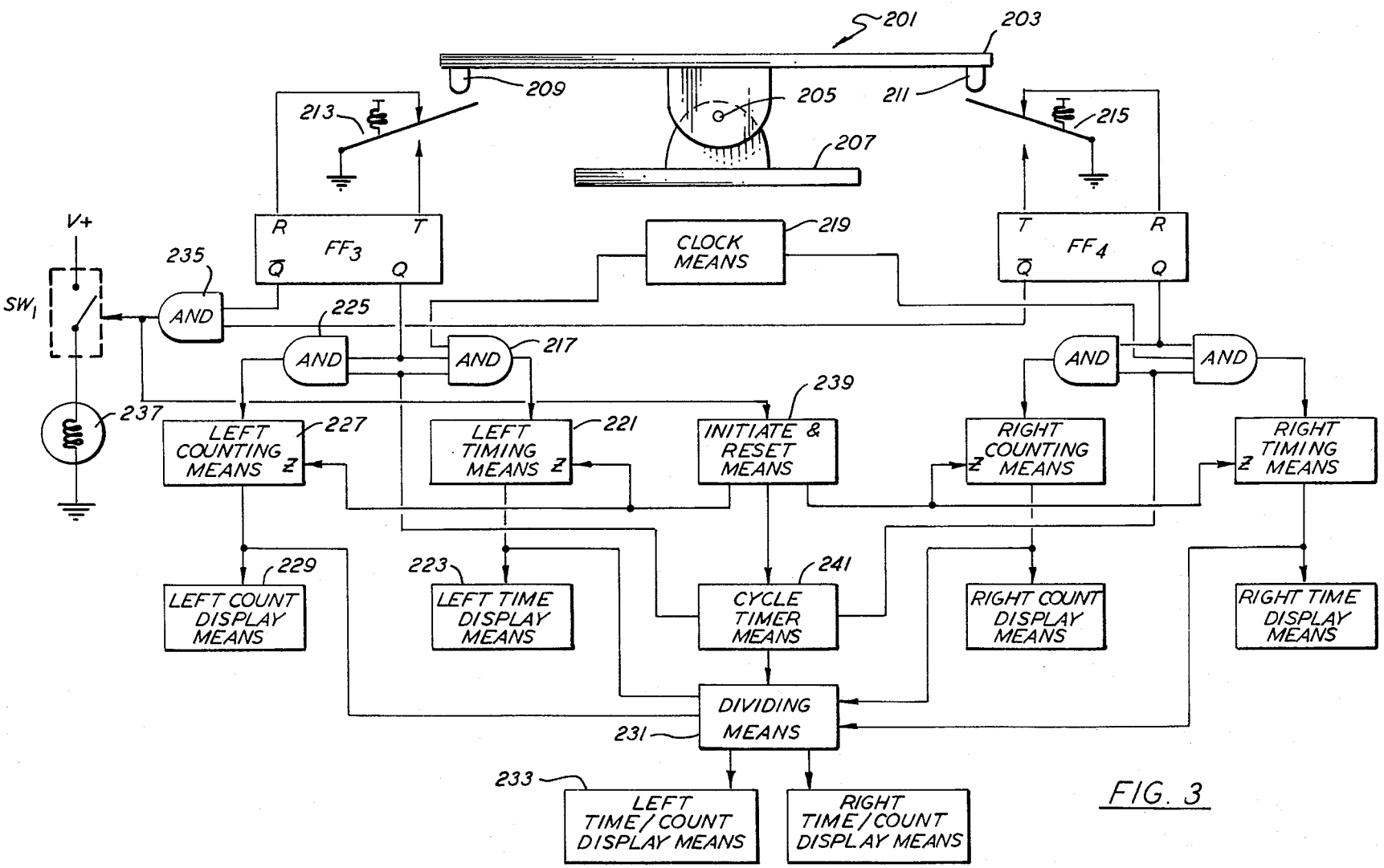
FIG. 3 is a schematic diagram of an embodiment of apparatus according to the invention employing left and right electronic counting and display means.

Obviously, the rocker board may become unbalanced in either of two directions when it is inclined to the horizontal direction. One imbalance position may be described as the left imbalance position and the other as the right imbalance position. Just as with the mechanical embodiment previously described, it is sometimes useful with an electronic embodiment to measure separately the number of right and left imbalances experienced during a test cycle and the duration of right and left imbalances. Turning to FIG. 3, circuitry analogous to that of FIG. 2 is shown, which permits the separate measurements described. Because of the similarity of the circuitry of FIGS. 2 and 3, it is only necessary to describe the differences between the circuits. The beam balance means 201 includes a rocker board 203 pivotally connected by pivot 205 to a base 207. The left end of rocker board 203 has a protrusion 209 which in the left imbalance position depresses the movable grounded contact of a single-pole, double-throw switch 213. A similar right end protrusion 211 actuates the movable grounded contact in the right imbalance position of a single-pole, double-throw switch 215. Switches 213 and 215 function as switching means for activating a left counting means and a left timing means and a right counting means and a right timing means, respectively, upon the occurrence of a left and right imbalance, respectively. That is, the respective counting and timing means are activated when rocker board 203 moves from the generally horizontal or balance position to the left imbalance or right imbalance position, i.e. inclined with respect to the horizontal on one or the other sides of pivot 205.

The normally grounded pole of switch 213 is connected to a reset terminal R of an RS flip flop $FF_3$ and the normally open pole of switch 213 is connected to the setting terminal T of flip flop $FF_3$. The Q output terminal of flip flop $FF_3$ is connected to one of three inputs of an AND gate 217, the output signal of clock means 219 being connected to a second input of gate 217. The output signal of AND gate 217 is applied to a left timing means 221 which drives a left time display means 223. The Q output of flip flop $FF_3$ is also connected to an input terminal of an AND gate 225, the output of which is connected to a left counting means 227, the output signal of which drives a left count display means 229. The output signals of left counting means 225 and left timing means 221 are applied to a dividing means 231 for producing the quotient of the left count and left imbalance duration. Dividing means 231 drives a left time/count display means 233. The $\overline{Q}$ output of flip flop $FF_3$ and the $\overline{Q}$ output of an RS flip flop $FF_4$, which is the right imbalance position analog of $FF_3$, are connected to an AND gate 235. The output of gate 235 closes an electronic switch $SW_1$ which connects power supply V+ to indicator 237. The output of AND gate 235 is also connected to an initiate end reset means 239 for initiating a test cycle and resetting the counting and timing means after a test cycle is completed. The output of initiate and reset means 239 is applied to reset terminals Z of left timing means 221 and left counting means 227 and to a cycle timer means 241. Cycle timer means 241 times the duration and signals the end of a preselected variable test cycle interval. The output signal of cycle timer means 241 is transmitted to one input terminal of AND gates 217 and 225 and to dividing means 231.

As before, the circuitry of FIG. 3 provides for a variable, preselected fixed time length test cycle automatically beginning when the test subject first balances rocker board 203. A manual system could be provided with the elimination of gates 225 and 235, switch $SW_1$ and indicator 237, as well as cycle timer means 241 and one input to gate 217 in a manner obvious to one skilled in the art. A test cycle would then be manually commenced and ended through initiate and rest means 239.

As before, the operator manually resets left count and time display means 223 and 229 through left counting and timing means 221 and 227, before a test cycle begins, through initiate and reset means 239. Likewise, cycle timer means 241 is armed manually by the operator through initiate means 239. When the test subject stands or rocker board 203 first imbalancing it and then gains his balance, the $\overline{Q}$ outputs of flip flops $FF_3$ and $FF_4$ go high, triggering a high output from AND gate 235. If switch $SW_1$ is present, indicator 237, which may be a light source, is turned on signaling the beginning of a cycle. The light output is either optically coupled through an optoelectronic device to trigger cycle timer means 241 to begin timing a test cycle, or the high level output of gate 235 is fed through initiate means 239 to trigger cycle timer 241. A high state output signal from the cycle timer means enables one terminal of each of AND gates 217 and 225 during the testing cycle time. Thus, during the test cycle, each timer rocker board 203 becomes imbalanced in the left imbalance position, switch 213 is tripped and the Q output signal of flip flop $FF_3$ assumes the high level state. The transition from high to low reaches left counting means 227, preferably a conventional integrated circuit counter, in which the accumulated count is incremented by one, resulting in an increment by one of the numbers visually displayed on left count display means 229. Left count display means is preferably a conventional seven segment digital display as previously described in connection with FIG. 2. The high level Q signal output also enables the timing pulses from clock means 219 to reach left timing means 221, preferably a conventional counter, where the duration of the high level Q signal is measured by counting the number of timing pulses received. Left time display means 223 displays the accumulated timing pulses, i.e., time, as previously explained in connection with FIG. 2. When the left imbalance position no longer is maintained, switch 213 drops back to its normal position and the Q output signal of flip flop $FF_3$ returns to the low state. AND gates 217 and 225 are then disabled so that no more timing pulses from clock means 219 reach left timing means 221, i.e., the measurement of the duration of the left imbalance position ends with the removal of the left imbalance condition.

At the end of a timing cycle, the output signal of cycle timer 241 switches states disabling gates 217 and 225 and triggering dividing means 231 to calculate the quotient of left count and time, i.e., the left reaction time, for display on left time/count display means 233 in the manner previously described in connection with FIG. 2 and the other display means.

Entirely analogous circuitry is shown in FIG. 3 for counting the number of right imbalance positions achieved and measuring the total time the right imbalance position is maintained. Right display means visually display the number of right imbalances and their total duration as well as their quotient. Thus, both right and left imbalance characteristics can be measured with the embodiment of the invention schematically depicted in FIG. 3.

Figure 4:
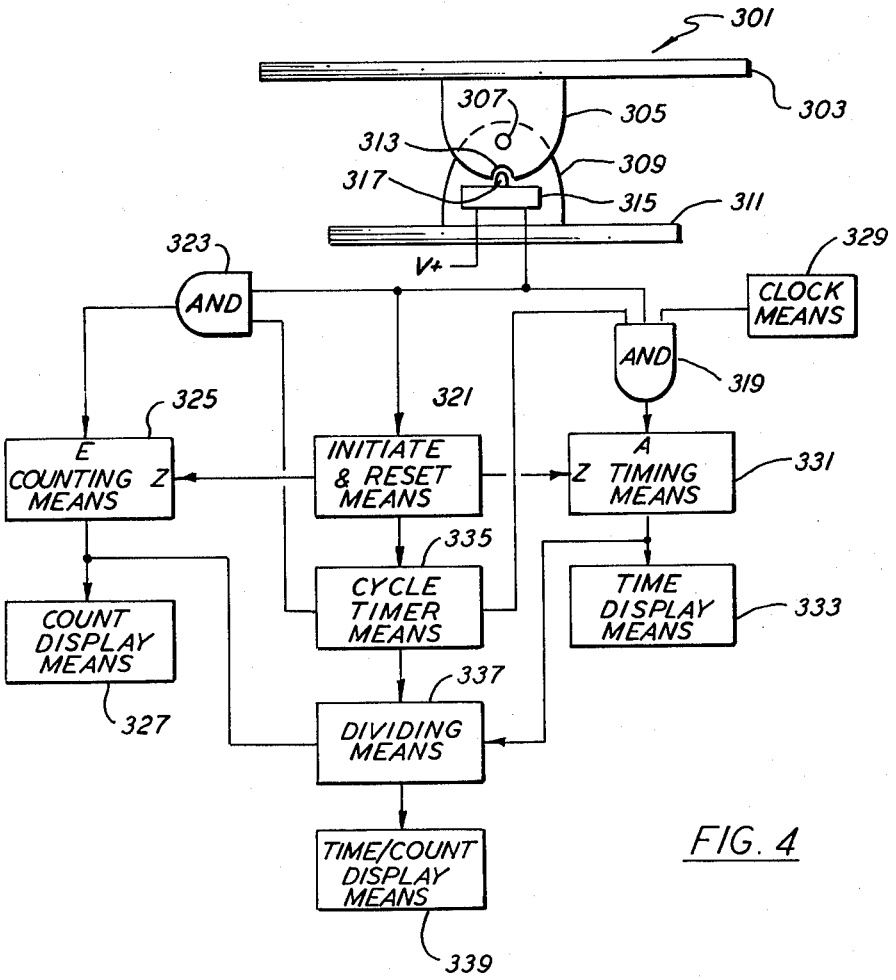
FIG. 4 is a schematic diagram of another embodiment of apparatus according to the invention employing electronic counting and timing means.

A simplified embodiment of the invention using electronic circuitry is shown in FIG. 4. There, balance beam means 301 has a rocker board 303 mounted on a first transverse support 305, which is pivotally connected by a pivot 307 to a second transverse support 309, which in turn is mounted to a base 311. Support 305 is formed with an inset 313. A switch 315 preferably a microswitch, having an actuating lever or projection 317 is mounted on the balance beam means. Inset 313 is shaped to accommodate switch actuating lever 317 and allow its normal full extension when rocker board 303 is in the balance position. When the rocker board becomes inclined in either direction, support 305 depresses lever 317 and actuates switch 317. Switch 317 may be a normally open or normally closed switch, the embodiment shown in FIG. 4 being normally open. A power supply voltage V+ is connected to one terminal of the single-pole, single-throw switch 317. Thus, closing of switch 317 by movement of rocker board 303 to an imbalance position connects the voltage to the other switch terminal. That latter terminal is connected to one of three input terminals of an AND gate 319, to initiate and reset means 321 and to an input terminal of AND gate 323. The output of AND gate 323 is connected to a counting means 325 which drives a count display means 327. The output of a clock means 329 is connected to another terminal of AND gate 319. The output of AND gate 319 connects to a timing means 331 which drives a time display means 333. Initiate and reset means 321 is connected to reset terminals Z of counting means 325 and timing means 331 and to cycle timer means 335. The output signal of cycle timer means 335 is connected to input terminals of AND gates 323 and 319 and to dividing means 337. Dividing means 337 drives time/count display means 339.

As explained for the earlier described embodiments, the embodiment of FIG. 4 provides for automatic initiation of a test cycle of a preselected fixed time interval. If totally manual operation is satisfactory, the embodiment of FIG. 4 can be further simplified by eliminating AND gate 323, cycle timer means 335 and removing one input terminal of AND gate 319, all in a manner obvious to one skilled in the art. Dividing means 337 and time/count display means 339 are optional.

Since much of the circuitry of FIG. 4 functions in a similar or identical manner to that already described for FIGS. 2 and 3, it is necessary only to explain the differences in operation from those circuits. In the following description it is assumed that a test cycle is underway with the cycle timer 335 sending high level state signals to AND gates 319 and 323. When switch 315 is then closed, a high level signal reaches the second input terminal of AND gate 323, sending a high level signal to counting means 325 which increments by one the accumulated count. That is, for each imbalance the count is incremented by one. Closing of switch 315 also places a high level signal at the second of the three input terminals of gate 319. So long as that condition exists, timing means 331, preferably a conventional counter, increments by one for each timing pulse generated by clock means 329. That is, the length of time rocker board 303 is not in the balance position is measured by timing means 331 by counting timing pulses and the total count is displayed by time display means 333. The other circuit elements depicted in FIG. 4 function just as previously explained for FIGS. 2 and 3.

The entire apparatus is lightweight and portable. The circuitry of the electronic embodiments may be constructed to consume low power so that the apparatus can be battery operated. Depending upon the extent of use of the apparatus, the sophistication, degree of automation and cost can be varied to suit conditions. The apparatus can be arranged for operation by the test subject who may observe the count and time scores directly during a test.

The invention has been described with reference to and emphasis upon certain embodiments of it. Various modifications, omissions and additions to the embodiments described will be readily apparent to those skilled in the art. Therefore, our invention is limited solely by the following claims.

We claim:

1. Apparatus for measuring a person's balance, said apparatus comprising:

balance beam means for moving between positions of balance wherein the person maintains his balance, and imbalance wherein the person loses his balance;

counting means for counting the number of times said balance beam means moves from the balance position to an imbalance position;

first switching means for actuating said counting means in response to movement of said balance beam means from the balance position to an imbalance position including a first switch actuated by said balance beam means;

count display means for visually displaying the counted number of times said balance beam means moves from the balance position to an imbalance position; and timing means for measuring the time said balance beam means remain in an imbalance position.

2. The invention according to claim 1 further including timing switching means actuated by said balance beam means for activating said timing means in response to movement of said balance beam means from the balance position to an imbalance position and deactivating said timing means in response to movement of said balance beam means from an imbalance position to the balance position.

3. The invention according to claim 2 wherein said timing switching means comprises a first electrical switch actuated by said balance means, and said timing means comprises an electronic timing means.

4. The invention of claim 3 further including cycle timer means for timing operation of said balancing apparatus and signaling the end of a period of operation of said apparatus.

5. The invention of claim 3 further including dividing means for producing the quotient of the time said balance beam means has remained in an imbalance position and the counted number of times said balance beam means has moved from the balance position to an imbalance position.

6. The invention of claim 5 further including count/time display means for electrically displaying said quotient.

7. The invention according to claim 2 further including time display means for visually displaying the measured time said balance beam means has remained in an imbalance position.

8. The invention according to claim 1 wherein said balance beam means comprises a rocker board mounted on a pivot, said rocker board being generally horizontal in said balance position and inclined relative to the horizon in said imbalance positions.

9. The invention according to claim 1 wherein said balance beam means is generally horizontal in the balance position and inclined in one direction for a left side imbalance and inclined in a second direction for a right side imbalance, said counting means comprises left side counting means and right side counting means for counting the number of times said balance beam moves from the balance position to the left side and to the right side imbalance positions, respectively, said first switching means including left switching means for activating said left side counting means and right switching means for activating said right side counting means in response to movement of said balance beam from said balance position to said left side and to said right side imbalance positions, respectively, said count display means includes left side count display means and right side count display means for visually displaying the counted number of times said balance beam means moves from the balance position to said left side and to said right side imbalance positions, respectively, and said timing means includes left side timing means and right side timing means for measuring the time said balance beam means remains in said left side and in said right side imbalance positions, respectively.

10. The invention according to claim 9 further including second switching means for activating and deactivating said left side timing means in response to movement of said balance beam means into and out of said left side imbalance position, respectively, from said balance position and for activating and deactivating said right side timing means in response to movement of said balance means into and out of said right side imbalance position, respectively, from said balance position.

11. The invention according to claim 10 wherein said second switching means comprises at least one electrical switch actuated by said balance beam means and said left side and right side timing means comprise electronic timing means.

12. The invention according to claim 11 further including left side time display means and right side time display means for visually displaying the measured time said balance beam means has remained in said left side and in said right side imbalance positions, respectively.

13. The invention according to claim 11 further including cycle timer means for timing operation of said balancing apparatus and signaling the end of a period of operation of said apparatus.

14. The invention of claim 11 further including left side dividing means and right side dividing means for producing the quotient of the time said balance beam means has remained in the left side imbalance position and the counted number of times said balance beam means has moved from the balance position to the left side imbalance position and the quotient of the time said balance beam means has remained in the right side imbalance position and the counted number of times said balance beam means has moved from the balance position to the right side imbalance position, respectively.

15. The invention of claim 14 further including left side count/time display means and right side count/time display means for electrically displaying said quotients, respectively.

* * * * *